United States Patent [19]

Denroche

[11] 3,958,336

[45] May 25, 1976

[54] DEVICE FOR LINEAR MEASUREMENT

[76] Inventor: Charles Henry Pentland Denroche, 90 Park Road, Hampton Wick, Kingston-upon-Thames, Surrey, England

[22] Filed: Nov. 11, 1974

[21] Appl. No.: 522,756

Related U.S. Application Data

[63] Continuation of Ser. No. 447,558, March 4, 1974, which is a continuation of Ser. No. 292,423, Sept. 26, 1972, abandoned.

[52] U.S. Cl. ..... 33/125 A; 33/1 M

[51] Int. Cl.² ..... G06G 1/00

[58] Field of Search ..... 33/1 M, 125 R, 125 A, 33/125.3

[56] References Cited

UNITED STATES PATENTS

| | | | |
|---|---|---|---|
| 3,182,399 | 5/1965 | Price | 33/1 M |
| 3,372,485 | 3/1968 | Mangus et al. | 33/1 M |
| 3,449,833 | 6/1969 | Dzula | 33/1 M |
| 3,518,661 | 6/1970 | Wingate | 33/1 M |

*Primary Examiner*—William D. Martin, Jr.
*Attorney, Agent, or Firm*—William F. Frank

[57] ABSTRACT

For accurate measurement of the linear movement of a traveller relatively to a low-torque rotary transducer, a cylindrical pulley on the transducer is driven by a wire which extends between this pulley and an idler pulley to embrace both; the free ends of the wire are fastened to the traveller to form a taut loop of length exceeding the maximum stroke of the traveller. A box-section cover enclosing the driving system (except for a lengthwise slot for passage of the traveller) is closed at one end by the transducer casing and at the other end by a box carrying the idler pulley; slotted holes for screws fastening the cover to the transducer allow the wire loop to be pulled taut. The wire loop passes through slits in cleaning plates adjacent to each pulley. Plates on the traveller locate it in the cover after initial assembly and until the device is set up for use.

12 Claims, 4 Drawing Figures

DEVICE FOR LINEAR MEASUREMENT

This is a continuation of application Ser. No. 447,558 filed Mar. 4, 1974, which is a continuation of application Ser. No. 292,423 filed Sept. 26, 1972 (now abandoned).

This invention concerns the accurate conversion of the linear motion of a traveller to rotary motion of a transducer for the purpose of accurate measurement.

According to the invention the driving connection between a low-torque rotary transducer and a traveller movable linearly relatively thereto incorporates a pulley forming the driven element of the transducer, an idler pulley spaced therefrom, and a wire which extends between these pulleys to embrace both, with its free ends attached to the traveller to form a taut loop of greater length than the maximum stroke of the traveller.

A form of the invention is shown in the accompanying drawings, whereof:

In these figures, 1 is the low-torque transducer requiring to be driven. This is one of the known forms of transducer; it may for example comprise a stator system of light-sensitive cells and a rotor having a spindle turning on high-accuracy miniature ball bearings with an encoder disc rotating with the spindle to cut off light periodically from the cell system and so produce a regular succession of electrical pulses which can be counted. As this transducer — with any necessary auxiliary electronic components — is part of the combination only as a complete unit in its own box with projecting spindle, its construction, which forms no part of the invention, needs no detailed description and illustration.

Figure 1:
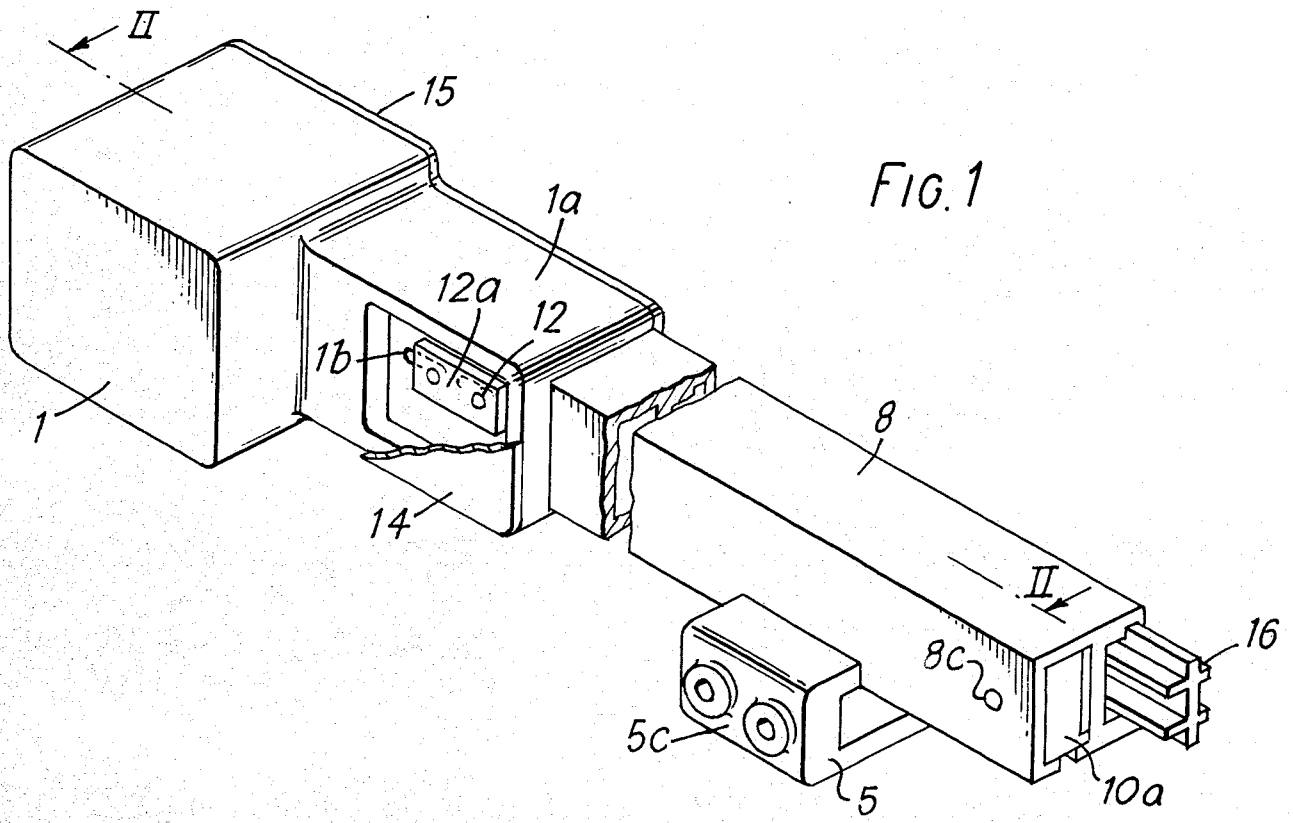
FIG. 1 is a general external view.
Figure 2:
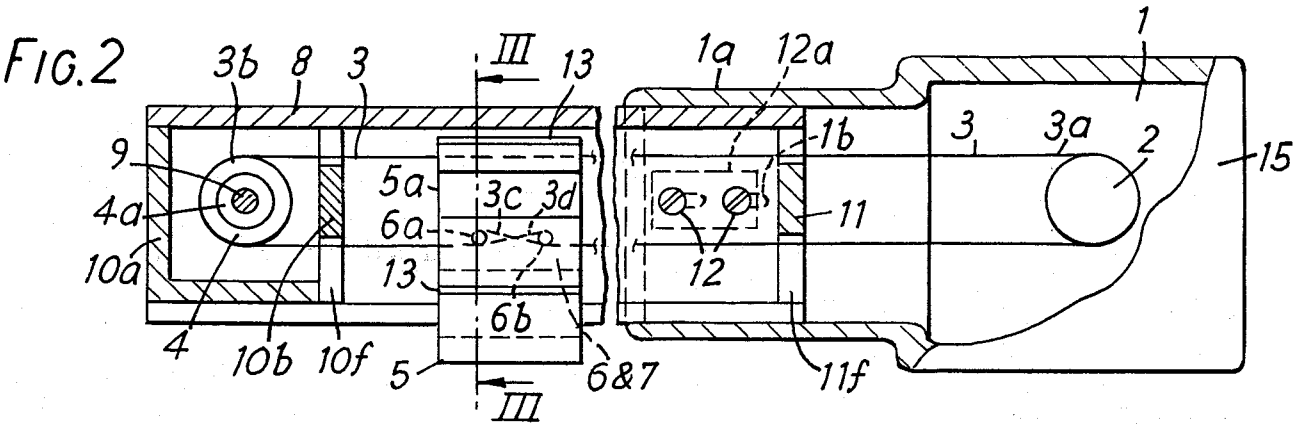
FIG. 2 is a rear lengthwise view on the plane II — II of FIG. 1 — i.e. with the back of the casing cut away to reveal the invention.

A cylindrical pulley 2 formed integrally with the spindle projecting rearwardly from the transducer is made to have with great accuracy a determined peripheral circumference highly accurately co-axial with the transducer rotor and bearings. A fine wire 3 passing with a half turn at 3*a* around the pulley 2, as seen in FIG. 2, and with another half turn at 3*b* around an idler pulley 4 (mounted as hereinafter described) has its ends 3*c* and 3*d* fastened to part 5*a* of a traveller 5 seen externally in FIG. 1. The channel section of part 5*a* can be seen in FIG. 3. The wire ends 3*c* and 3*d* cross over and pass respectively around pegs 6*a* and 6*b* projecting from a moulded fixing plate 6 and clamped between this and a second plate 7 pierced to fit over the pegs, the two fixing plates being rigidly held in the lower part of the channel portion 5*a*. The upper part of wire 5 passes freely through this channel 5*a*.

Figure 4:
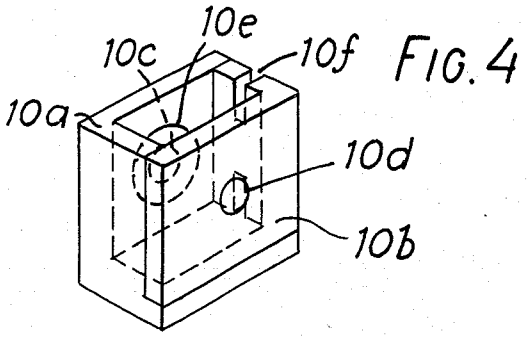
FIG. 4 is a detail of a box which carries the idler pulley.
Figure 3:
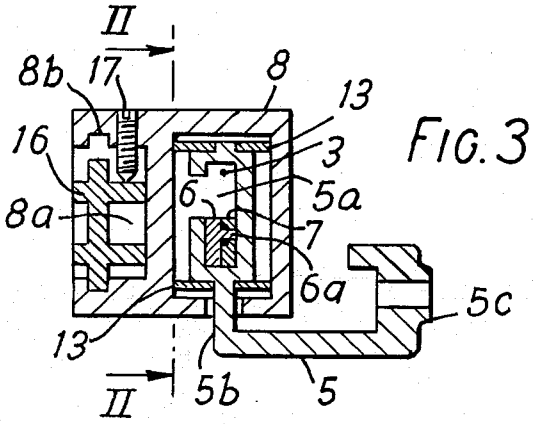
FIG. 3 is a cross-section on the line III — III of FIG. 2.

A member 8 providing a cover over the wire 3 and a track for the traveller 5 of channel or lengthwise-apertured box section as seen in FIG. 3 has its inner end closed by fitting into and being fastened to a channelled portion 1*a* extending from the transducer assembly 1. The flanged idler pulley 4 located at the far end of the track member 8 is part of or secured on to the outer race of a high-accuracy miniature ball-bearing of which the inner race 4*a* is fixed on pin 9 fixed through the aligned holes 10*c* and 10*d* in a box preferably, as shown in FIG. 4, in two parts 10*a* and 10*b* which fit into and plug up the far end of the track member 8. The box is held in the track, after insertion, by projecting the pin 9 into hole 8*c* in the track. Bosses on the inside of the box, around the holes 10*c* and 10*d*, and of which one is shown at 10*e*, locate the bearing race 4*a* between them. The wire 3 passes through slits 10*f* in a wall of the half box 10*b* whereby the wire would be cleaned of any accretions before it reaches the pulley 4. A plate 11 with slits 11*f* and fastened within the track member 8 at its inner end serves a similar purpose for the wire approaching the pulley 2. Since the track member 8 must have a lower aperture for the passage of the depending stem 5*b* of the traveller it cannot entirely keep out atmospheric dirt but a circular wire driving band passing through cleaning slits tends to keep quite clean, in contrast to a flat driving tape which would tend to consolidate a layer of dirt gradually building up on the driven pulley 2 and imparing the accuracy of the drive.

Fitted on to the top and bottom of the traveller part 5*a* are location plates 13 of nylon which are a low friction running fit within the track; these, by locating the traveller against sideways or tilting movement, protect the wire 3 against damaging tension which might be imposed by sideways deflection after initial assembly, during storage and transport, and they assist setting up for use as hereinafter described.

The length of the track, and hence the spacing of the pulleys, is such as to allow the desired maximum stroke of the traveller. Slotted fixing holes are provided to allow the pulleys to be drawn apart until the wire forms a taut loop. Thus, as shown, the fixing screws 12 fitting in holes in the track member 8 and visible in FIG. 2 and screwing into the double nut 12*a* seen in FIG. 1 pass through holes 1*b* in part 1*a* which are slightly elongated — a part of one hole being just visible beyond the nut. After final adjustment a sealed cover 14 — shown partly broken away in FIG. 1 to reveal the nut 12*a* — is fixed over the front opening in part 1*a* and another sealed cover 15 is fixed over the rear to prevent tampering with the adjustment unless the seals be broken.

It is found that the moving traveller pulling on one end of the wire or the other can rotate the transducer without noticeable slip or backlash; the wire is effectively unyielding under the small necessary driving force, which is well below that which can be transmitted frictionally by the taut loop to the pulley 2 without slip. The wire — which may be single or multi-strand — is shown diagrammatically in the cross-sectional view FIG. 3 by a dot larger than an individual strand; if there be two or more strands they will lie parallely beside each other, spaced slightly apart. Each strand must be of a non-corrosive metal which can be drawn to a very small uniform diameter with very great accuracy and which will not work-harden with repeated bending around the pulleys; preferably, for measuring long travels, the material should have a high value of E (Young's modulus). The material at present preferred is of Ni-Cr alloy of 0.1 mm diameter to an accuracy of ±0.00025 mm. The number of pulses given by precisely one half revolution of the transducer will correspond to a linear movement exactly equal to the length of wire wrapped around half the circumference of pulley 2; the sensitivity — i.e. the smallest step measurable — depends upon this number of pulses and upon the size of the pulley. Thus a 50 mm circumference giving 5000 pulses per revolution will measure a step of 0.01 mm (or a 2 inch circumference giving 4000 pulses will measure a step of 0.0005 inch). It is thought that the present invention is the first known means for measuring linear motion by making full use of the degree of accuracy and sensitivity afforded by a modern transducer.

It will be seen that the invention provides a complete piece of linear-measurement equipment which can be handled and sold as a unit and can be readily mounted on — for example — an existing machine tool and can if desired give a digital read-out.

The unit may be sold with a channelled fixing-bar 16 shown in section in FIG. 3 (and seen also in FIG. 1); the rear of the track member 8 has a channel 8*a* with grooves 8*b* fitting on to the bar 16. For mounting on a machine tool the bar 16 is removed and screwed to the bed of the machine in correct parallel relation to the sliding surface thereof; the unit is then replaced on the bar 16 and clamped in position by the screws 17. The plate 5*c* of the traveller is fastened to the machine slide. During this setting up the traveller is kept correctly located in the track by the plates 13 which thereafter in operation perform no useful function. It will be seen that the equipment could be fixed on other relatively moving parts — such as those of a drafting machine — and with either traveller or transducer fixed.

I claim:

1. Apparatus for highly accurate measurement of linear movement in increments in the range of from 1000 to 2540 mm per inch, comprising in combination: a first housing having a transducer mounted in one end portion thereof, said transducer having a stator system of light sensitive cells and a rotor system to cut light off periodically to produce a succession of electrical pulses which can be counted, the number of said pulses not exceeding 5000 per revolution of said rotor system; a driver pulley mounted on the spindle of said rotor system within said first housing; a second housing adjustably positionable at one of its ends within the other end portion of said first housing, said second housing having a linear support formed along one side thereof; an idler pulley mounted within said second housing adjacent the other end of said second housing in the same plane as said driver pulley in said first housing; traveller means mounted in said second housing and reciprocally movable along said linear support in a path which has its limits between said pulleys; at least one taut, unyielding drive loop of a single strand wire extending between said pulleys and encompassing said pulleys around one-half of their respective circumferences, said loop being secured to said traveller means, said second housing being adjustably positioned within said first housing to form said taut loop and secured in this position; said driver pulley having a circumference such that the increment of measure of linear movement of said traveller means corresponds to the ratio of one-half the said circumference to the number of pulses produced by one-half revolution of said rotor system; said wire being of a non-corrosive metallic composition which has been drawn to a very small diameter throughout its length with great accuracy and which will not work-harden from repeated bendings around said pulleys; said diameter being so small and said transducer having a driving torque so low that the rotation of the rotor system and movement of said traveller means occurs without noticeable slip of said taut driving loop.

2. The apparatus according to claim 1 further comprising means positioned transversely within said first housing adjacent said driver pulley and between said pulley and said path limit adjacent said pulley to provide a barrier against the passage to said circumference of said driver pulley of any accretion carried by said wire loop, thereby to change said ratio, said means defining slits admitting free passage of said loop therethrough.

3. The apparatus according to claim 1, wherein said wire has been drawn to a diameter of 0.1 mm with an accuracy of ±0.00025 mm.

4. A unitary measuring device for use in a system indicating the linear distance moved by a machine element, the device comprising: a housing means in which the length may be varied and secured in such position, a traveller element reciprocally movable along at least a portion of said housing means in a straight line path, rotary, electrical transducer means in one end of said housing means for providing an electrical output signal, and wire drive means in said housing means interconnecting the traveller element and the transducer means for communicating the mechanical input to said traveller element from the latter to the transducer means; said housing means having means for connection of the device to a first machine tool part, and having a longitudinal slotted opening in said portion of said housing parallel to said straight line path, said traveller element having means projecting through said slotted opening for connection of said element to a second machine tool part movable relative to said first machine tool part; said wire drive means including an idler pulley within said portion of said housing means approximate the other end thereof, a drive pulley within said housing means approximate the said one end thereof and rigidly mounted on said transducer means, and a taut, unyielding drive loop of wire having a very small uniform diameter throughout its length and of a composition which will not work-harden entirely within said housing and connected to said traveller element and entrained therefrom parallel to said slotted opening about both of said pulleys for communicating movement of said traveller element to said drive pulley to thereby impart mechanical input to said transducer means, said loop being made taut and so maintained by increasing the length of said housing means and securing same in said increased position; said housing means further incorporating a longitudinal support track parallel to said slotted opening, said traveller element being movable along said support track and located thereon until said device is connected to said machine parts, said wire diameter being so small and said transducer having a driving torque so low that the movement of said traveller with said second machine part imparts rotation of the rotor system of said transducer without noticeable slip.

5. The unitary measuring device according to claim 4, further comprising means positioned transversely within said housing means adjacent said drive pulley and between said pulley and said traveller element to provide a barrier against the passage to the circumference of said driver pulley of any accretion carried by said wire loop, said means defining slits admitting free passage of said loop therethrough.

6. The unitary measuring device according to claim 4, wherein said housing means comprises first and second housing sections which are slidable relative to each other, the first section containing said transducer means and drive pulley and the second section containing said idler pulley; said housing means including adjustable securing means interconnecting the first and second sections of said housing and permitting extensible relative movement therebetween to increase the spacing of said pulleys, thereby to establish and maintain the taut driving loop.

7. The unitary measuring device according to claim 6, wherein said first housing section comprises a projecting portion extending away from said drive pulley and transducer means and open at one end, said second section extending into the opening in said projecting portion and slidably supported therein, said interconnection means including securing means for fixing the projecting portion of the first housing portion and said second housing section within the projecting portion in said extended portion.

8. The unitary measuring device according to claim 6, wherein said straight line path comprises a guide channel defined inside said second housing section which is of rectangular cross-section, the guide channel being formed by the vertical walls of said portion, said slotted opening being formed in the bottom wall of said portion.

9. The unitary measuring device according to claim 6, said traveller element comprising an internal supporting portion for said projecting means and means on said supporting portion engaging the interior of said guide channel for holding said internal supporting portion in a vertical position therein prior to said connection of said projecting means to said second tool part.

10. A unitary measuring device according to claim 4, wherein said means for connecting said housing means to a first machine tool part comprises a bar to be secured to said part, said bar being detachably secured to the back of said housing means by the entry of one of these two parts into a channel formed in the other.

11. The unitary measuring device according to claim 6, wherein said idler pulley is mounted in a support enclosure positioned at said end of said second section and closing the exterior end of said section.

12. A unitary measuring device according to claim 11, further comprising means positioned transversely within said support enclosure adjacent said idler pulley to provide a barrier against the passage to said idler pulley of any accretion carried by said wire loop, said means defining slits admitting free passage of said loop thereto.

* * * * *